US006421502B1

(12) United States Patent
Aronie et al.

(10) Patent No.: US 6,421,502 B1
(45) Date of Patent: Jul. 16, 2002

(54) SMOKE GENERATOR AND TOY SMOKE-RING GUN USING SAME

(75) Inventors: Alan Aronie, Littleton; Joel Aronie, Chilmark, both of MA (US)

(73) Assignee: Quikpoint, Inc., Concord, CA (US)

( * ) Notice: Subject to any disclaimer, the term of this patent is extended or adjusted under 35 U.S.C. 154(b) by 0 days.

(21) Appl. No.: 09/732,508

(22) Filed: Dec. 7, 2000

(51) Int. Cl.[7] ..... D06F 75/18; F17C 7/04

(52) U.S. Cl. ..... 392/399; 392/404; 446/24

(58) Field of Search ..... 392/390, 394, 392/396, 397, 398, 399, 400, 401, 402, 403, 404, 405, 406; 261/142, 24, 25, DIG. 65; 446/24, 406, 407

(56) References Cited

U.S. PATENT DOCUMENTS 2,324,359 A * 7/1943 Callan ..... 446/24
2,628,450 A * 2/1953 Shelton ..... 446/24
3,234,357 A * 2/1966 Seuthe ..... 392/403
3,563,224 A * 2/1971 Bryer ..... 126/59.5
3,745,306 A * 7/1973 Naritomi ..... 392/335
4,493,211 A * 1/1985 Weinstein ..... 73/147

* cited by examiner

*Primary Examiner*—Sang Paik
(74) *Attorney, Agent, or Firm*—Peter J. Manus; Dike Bronstein Roberts & Cushman, Intellectual; Property Practice Group of Edwards & Angell, LLP

(57) ABSTRACT

A toy gun (10) produces a series of traveling smoke rings (12). It has a smoke chamber (14) fed with smoke from a battery (24)-powered electrical resistance generator (30). An elastic, edge-mounted diaphragm (74) extends across at least a portion of the rear of the smoke chamber (14). A reciprocating actuator (68) movable in response to a trigger (22) strikes the diaphragm (74) to eject a smoke ring (12) through an orifice (14*d*) in the opposite wall (14*a*) of the smoke chamber (14). The smoke generator (30) includes a supply tank (32) of a suitable liquid (34) and a source (36) of variable pressure to drive the liquid (34) through a narrow annular clearance (43) to the heater (38) where it is rapidly vaporized. The generator (30) includes a pair of concentric tubes (40,42) that define the annular clearance (43) and an electrical resistance heating element (38) mounted on one of them at a point spaced from the supply tank.

27 Claims, 3 Drawing Sheets

SMOKE GENERATOR AND TOY SMOKE-RING GUN USING SAME

FIELD OF THE INVENTION

The invention generally relates to apparatus for producing smoke, steam or fog, and more particularly, to a toy gun that produces one or more traveling smoke rings when fired.

BACKGROUND

Various toys are known that utilize smoke, steam, and fog (herein, collectively, "smoke") generators, and a variety of generators for producing smoke for toys, theatrical productions, and the like are also known. See, e.g., U.S. Pat. No. 3,891,826. Liquid mixtures specifically designed for use in such generators are also known. See, e.g., U.S. Pat. No. 3,342,746.

Toy guns have captured the popular imagination for many years. Metcalf, E. W. and Maresca, F., Ray Gun (1999) Fotofolio, Inc., New York, N.Y. is devoted to one type of toy gun, a ray gun. In particular, smoke-producing toy guns are known. U.S. Pat. No. 2,855,714 describes a toy gun that produces smoke ringsthrough the detonation of percussive caps within the gun casing.

While the visual effects and realism of smoke-producing toy guns are significant advantages, a number of drawbacks have limited their commercialization. For example, many prior smoke generators for toys employ mixtures that are not always completely safe. In particular, many oils and oil-based mixtures for making smoke have not been approved for human use. Children may be especially prone to injury from exposure to or mishandling of such fluids, or to heaters used to vaporize liquids to make smoke.

Many prior generators, such as those employed in model railroads, have an open smoke producing device, usually a chimney on an engine, that operates continuously. This arrangement is not conducive to producing smoke rings. It also can be sensitive to orientation—a smoke generator for a fixed, upright smokestack on a model train may not function, or function well, when used in a toy that may assume orientation other than upright. Further, continuous smoke production and the power requirements of such production also militate against the portability of the toy or other device using smoke.

Prior toy guns have used detonation of percussion caps to make smoke. This arrangement is portable and does not require electrical power, but it clearly may not be suitable for use by or near children because of the harmful percussion cap explosions. Percussion caps also produce the noise of a cap explosion, which may be a negative attribute to many.

U.S. Pat. No. 3,342,746 to Seuthe discloses oil-based fluids and a generator for producing smoke. As noted above, such fluids may not be completely without adverse health reactions, particularly when used in closed rooms. In particular, exposure to such fluids in aerosol form can produce significant eye, nose and throat discomfort.

A later Seuthe patent, U.S. Pat. No. 3,891,826, describes a smoke generator that relies on a capillary action to draw the liquid from a central, open-top reservoir to a heated region where it vaporizes to provide a smoke or fog. Such generators require an upright orientation for optimal use (due to the effect of gravity on a capillary action that feeds fluid to a resistance heater) and to avoid fluid loss, e.g., due to an outflow from the fluid reservoir. Also, use of electrical resistance wires or coiled wires in many prior generators to vaporize a fluid has presented unacceptable power requirements for portable devices operated with batteries. With model railroads, in contrast, power is typically supplied by household electrical current through a step-down transformer. Further, the narrow clearances and related manufacturing requirements make the Seuthe generator comparatively difficult to manufacture.

It is therefore a principal object of this invention to provide a smoke generator that is portable, safe, fast-acting for non-continuous operation, has comparatively low power requirements, and is substantially orientation insensitive.

Another principal object of this invention is to provide a portable, battery-powered smoke-ring gun that uses electrical resistance heating to produce the smoke.

A further object is to provide a smoke ring gun with the foregoing advantages of the smoke generator of the present invention that also has a favorable cost of manufacture.

A still further object is to provide a smoke ring gun with the foregoing advantages that can generate smoke from a water-based liquid.

SUMMARY OF THE INVENTION

The present invention provides apparatus for producing smoke and a toy gun that fires to produce smoke in a traveling ring shape, and in particular is capable of producing a succession of smoke rings traveling from the gun in its direction of aim. A particular toy gun includes a smoke chamber fed by an electrical resistance smoke producing generator. The chamber has an elastic, edge-mounted diaphragm, or equivalent moveable member, that co-acts with the chamber and an outlet orifice formed in a front wall of the chamber to produce the smoke rings. The smoke generator used in the gun is preferably the smoke generator of the present invention. The generator and toy gun can operate with water-based smoke-producing liquids.

The invention includes a smoke generator that includes at least one, and preferably all, of the following components:

a) a supply tank that holds the liquid, b) a source of variable fluid pressure (e.g. air) in sealed fluid communcation with the supply tank for increasing and decreasing fluid pressure in the tank to feed the liquid to and from a heating unit; and c) a heater adapted to receive and vaporize a small portion of the liquid fed from the supply tank in response to an increase in the fluid pressure.

In a preferred form of the invention, the heating unit includes at least one and preferably all of the following components:

d) a first tube with a first end entering into the supply tank, and a second smoke outlet end; and e) a heater positioned at least partially within the first tube for vaporizing the pressurized liquid driven by an increase in the pressure into a narrow annular region between the heating element and the surrounding tube.

The spacing is such that the pressure increase feeds the fluid to a region adjacent the heater on rapid vaporization, but does not usually overflow the tube, or have a sufficient thermal mass that rapid vaporization of the liquid is difficult. Typically, the heater is an electrical resistance wire that is coiled. When used in a toy gun of the present invention, the variable fluid pressure source is preferably a bulb made from a pliable material, such as rubber, or the like.

The resistance coil is preferably sealed within a heat conductive tube, e.g., a glass tube. In most invention embodiments, the heating element will be suspended in the first tube, usually by means of one or more lead wires to the electrical resistance wire. Also in the preferred form, a second metal tube concentrically surrounds the first tube for mechanical protection and insulation. Overflow and condensate that flow to the bottom of the generator are drained to a closed collection compartment.

In a preferred embodiment, the smoke generator is positioned below and in fluid communication with the first chamber. Also, the smoke generator is actuated by 1) an electrical on-off switch that controls the flow of current from a battery or batteries, preferably secured in a handle or grip portion of the gun body, to the electrical resistance wire, and 2) a variable pressure liquid supplier, e.g. a flexible rubber bulb that is squeezed by the user to create a positive air pressure in a liquid supply tank, thereby forcing smoke liquid to the heater. Typically, this produces an instant burst of smoke filling the smoke chamber. When the pressurized fluid supplier is disengaged (released), negative pressure is delivered to the tank, which in turn clears all, or most, of the smoke liquid from the generator.

The invention also provides a toy gun that includes at least one and preferably all of the following components:

a) gun body, b) a smoke chamber at one end of the gun body and having spaced apart front and rear walls and a side wall, c) a member movable axially to form pressure waves within the smoke chamber forming at least a portion of said rear wall, d) an orifice in said front wall, e) a smoke generator operably coupled to the smoke chamber that includes a system for pressurizing a liquid and heating same to vaporize the liquid to produce smoke; and f) an actuator, preferably an elongated member mounted in the gun body for an axial sliding movement and spring-driven toward a forward position where it strikes the diaphragm to create a pressure wave inside the smoke chamber that interacts with the orifice to produce a traveling smoke ring.

The smoke generator is preferably the smoke generator of the present invention. It is battery-powered and has an electrical resistance heater that vaporizes a portion of a liquid from a supply of the liquid carried in the gun. The movable member is preferably a latex rubber sheet of generally circular configuration, but is edge-mounted, preferably with a low tension across the sheet. The actuator head is preferably rigid. The drive-spring is preferably adjustable to vary the strike force of the actuator on the diaphragm. The actuator is operatively coupled to a trigger that cocks, and then releases, the actuator to move under the forces of the compressed spring. The smoke generator preferably uses a flexible bulb, activated by a second trigger as a hand grip, to produce smoke for the smoke chamber. A light source is provided in the smoke chamber. It can be actuated by the same switch that powers the smoke generator, although in other embodiments the light source may be controlled by a separate switch.

BRIEF DESCRIPTION OF THE DRAWINGS

Still other features, advantages and aspects of the present invention will become more apparent from a description of illustrative embodiments hereinafter, when read in conjunction with the drawings of which.

DETAILED DESCRIPTION OF THE PREFERRED EMBODIMENTS

Figure 1:
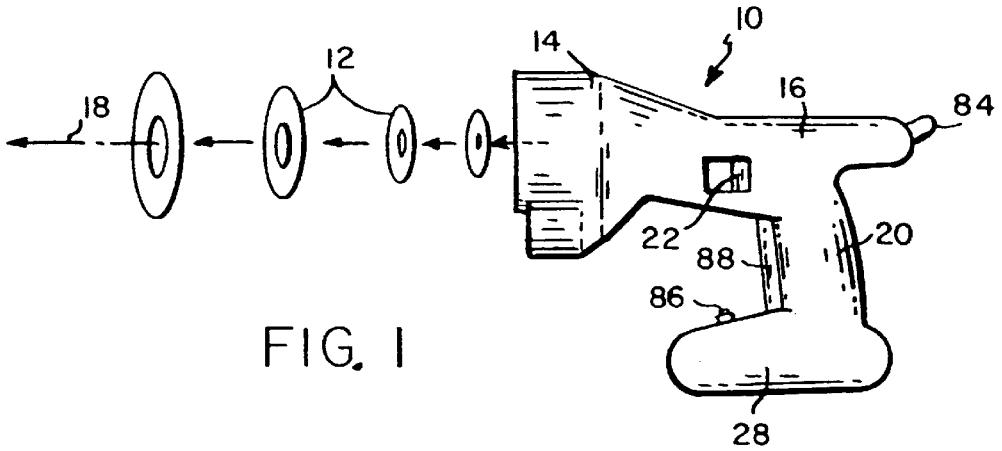
FIG. 1 is a view in side elevation, showing a toy smoke-ring gun according to the present invention, and a succession of traveling smoke rings produced by the gun.
Figure 3:
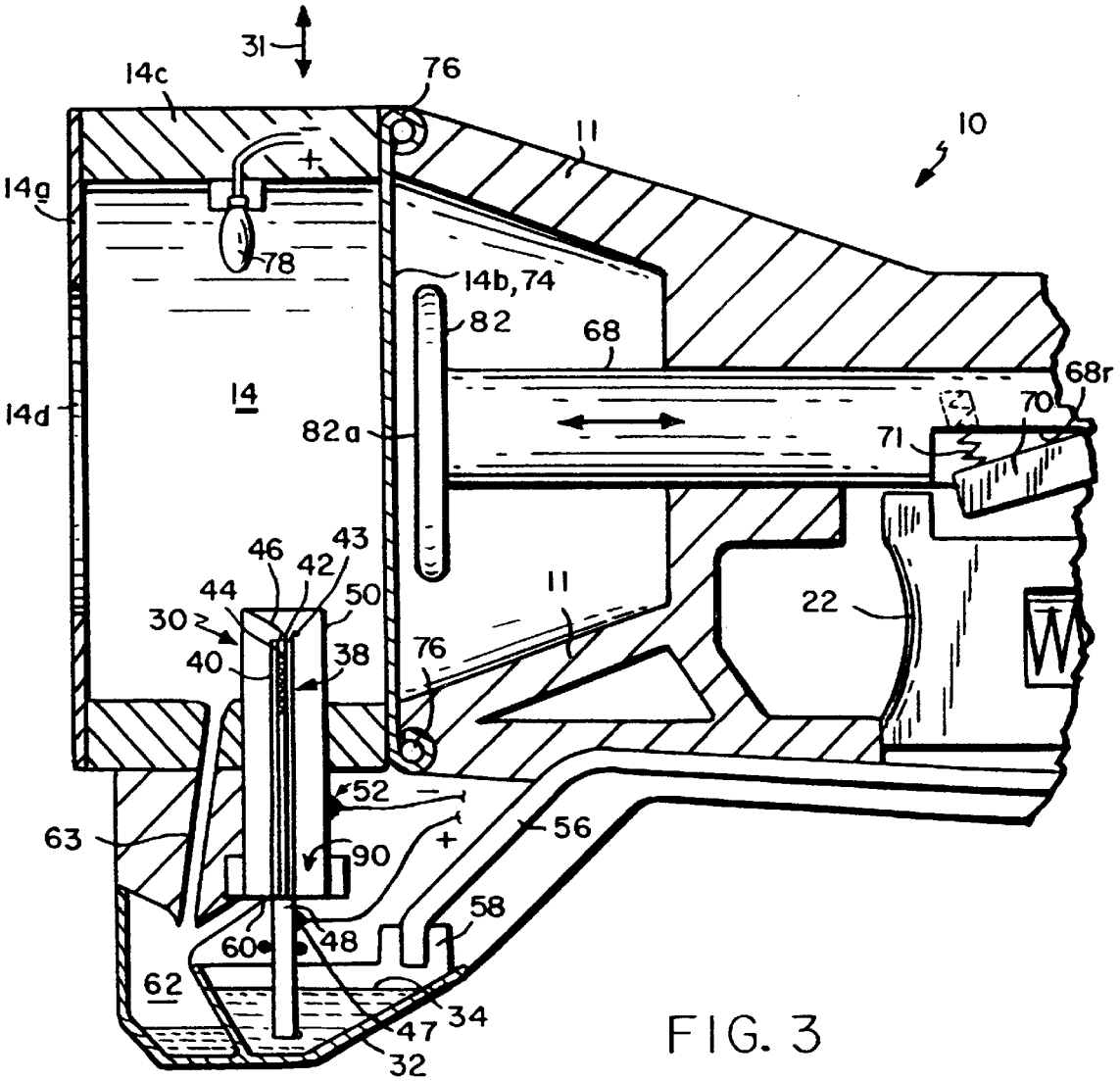
FIG. 3 is an enlarged view in vertical cross-section of the smoke generator shown in FIG. 2.
Figure 2:
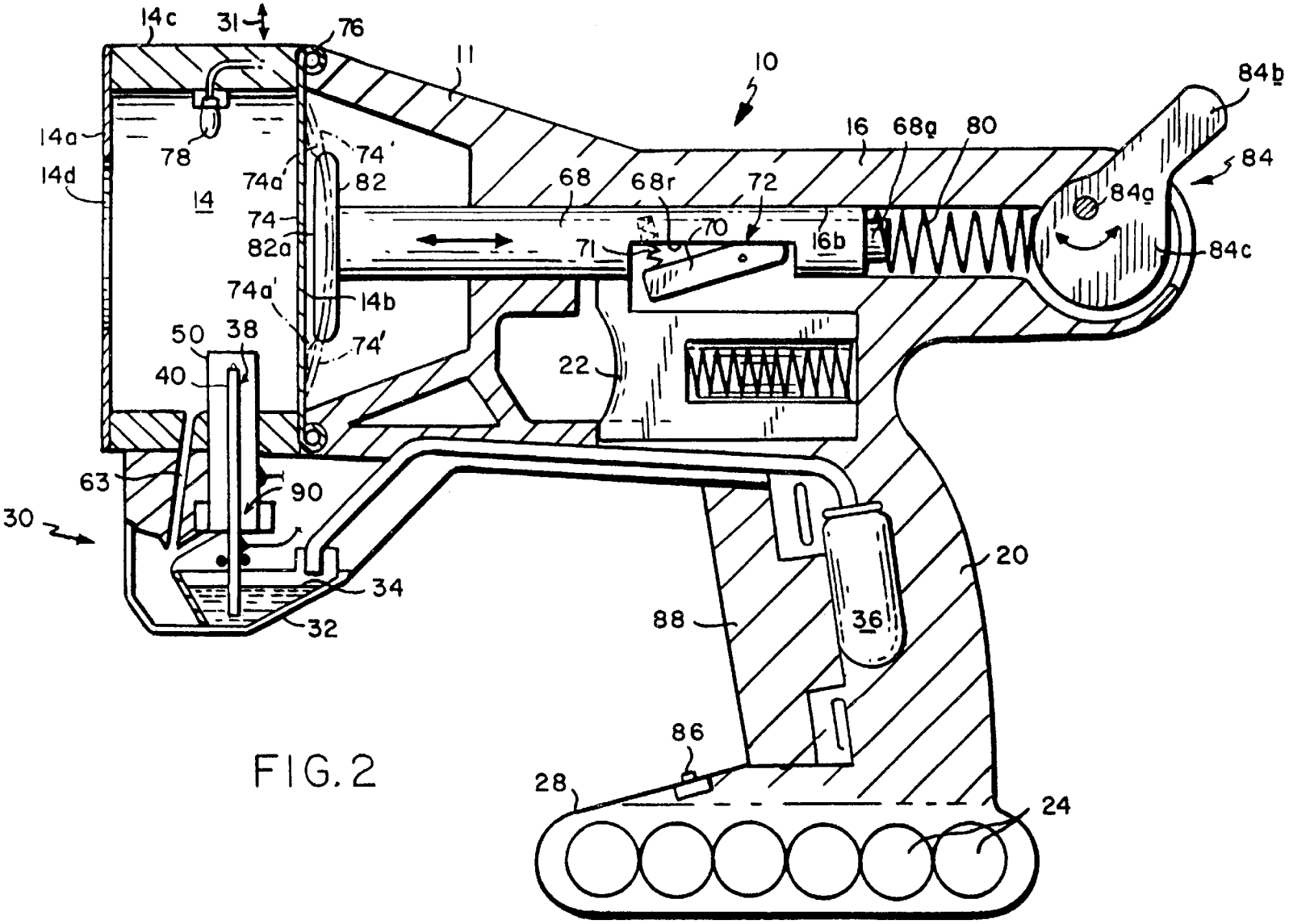
FIG. 2 is a view in vertical cross-section of a preferred embodiment of a smoke-ring gun according to the present invention.

FIGS. 1–3 show a toy smoke-ring gun 10 according to the present invention and a succession of smoke rings 12 produced by the gun 10. The rings 12 are ejected from a smoke collection chamber 14 located at the front of the gun 10 and secured, e.g. by a set of struts 11, on a gun body 16. The rings travel axially in the direction of arrow 18. In the preferred form shown, the gun 10 is in the form of a pistol with a hand grip 20 and a trigger 22. As will be described below, the form, number and speed of the smoke rings are all adjustable. Smoke is produced by a user of the gun on demand to fill the chamber 14. Rings can be generated automatically, but preferably one ring is produced with each pull of the trigger 22 provided that there is sufficient smoke accumulated in the chamber 14. The gun 10 is preferably powered by batteries 24. The operation of the gun 10 is invariant to its orientation. It can be placed on its side when not in use without spilling a liquid supply held in a tank 32 and vaporized in small volumes to create the smoke. However, when not in use, in its presently preferred form shown in FIGS. 2 and 3, the gun 10 rests on a flat-bottomed base 28 found at the bottom of the hand grip 20 and serving as a holding compartment for multiple batteries 24. The weight of the batteries, and the configuration of the base, provide a stable support for the gun 10 when it is not in use.

Figure 4:
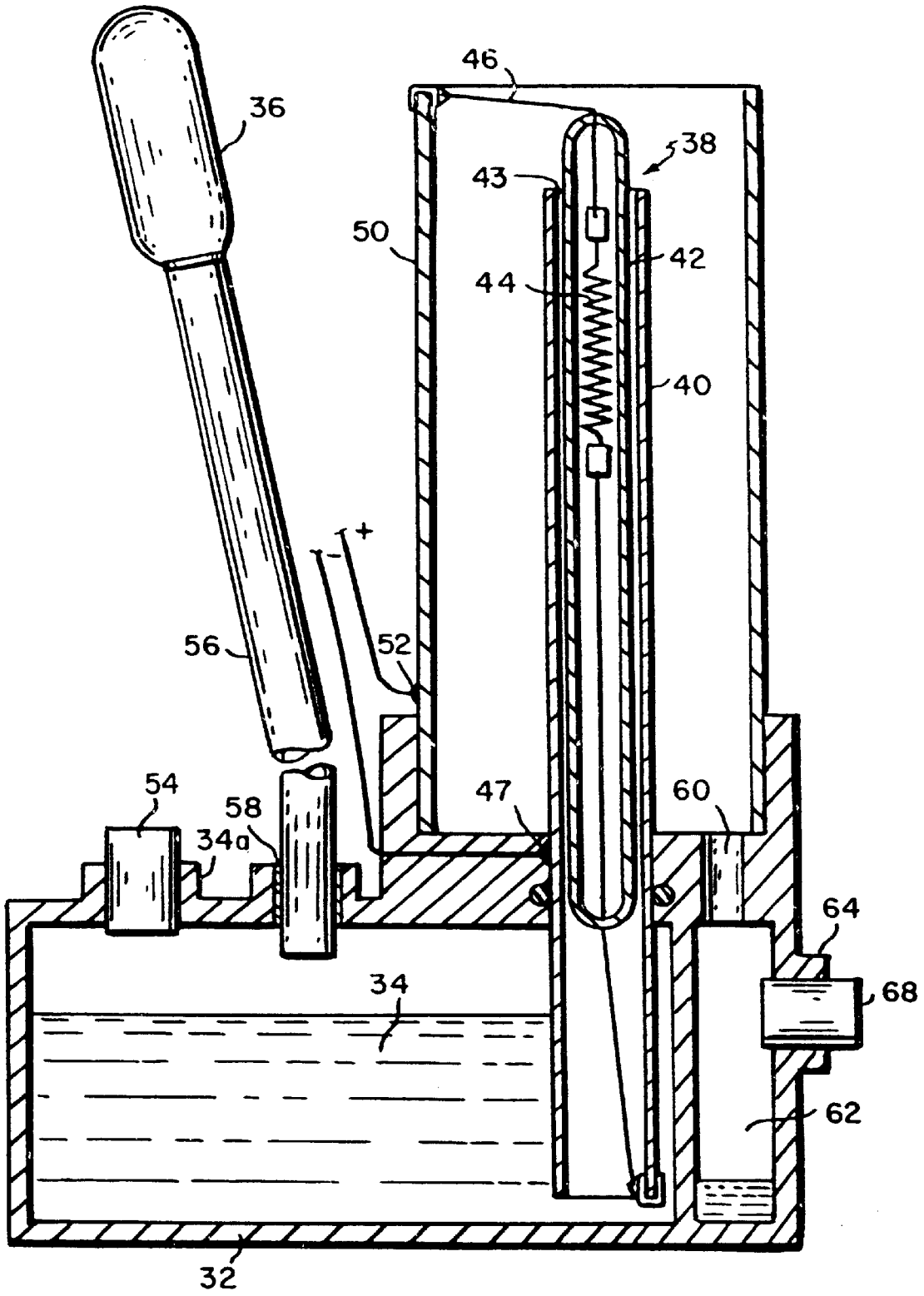
FIG. 4 is a detailed view in vertical section corresponding to FIG. 3 showing an alternative form of a smoke-generator according to the present invention.

A central feature of the present invention is an on-demand, battery-powered, orientation-insenstive, smoke generator 30 shown in detail in FIG. 3, and in an alternative form, in FIG. 4 (like parts being marked with the same reference number in both figures). The smoke-ring generator 30 includes the tank 32 that holds a supply of a liquid 34 to be vaporized, an air-filled rubber bulb 36 to pump the liquid to a heating region, and a heater 38, preferably one using an electrical resistance heating wire. The wire is preferably coiled, and will be referred to herein as a "coil", but the term "coil" is not limited to a resistance heater element that is actually in a helical or coiled form. As shown, the generator is in its preferred orientation, with arrow 31 indicating the vertical.

A tube 40 is mounted generally vertically through the upper wall of the tank 32 so that the bottom of the tube 40 ends slightly above the bottom of the tank. A high temperature glass tube 42 of the heater 38 is mounted coaxilly inside the metal tube 40, with a narrow annular space 43 therebetween. The bottom of the glass tube is above the top of the liquid 34 in the tank 32. The top of the glass tube 42 extends above the top of the metal tube 40. Inside the glass tube 42 an electrical resistance wire or coil 44 is positioned so that the top of the coil is just below the top of the metal tube 40, and the bottom of the coil is well above where the metal tube 40 goes through the tank 32. The position of the coil limits heat transmission principally to the area of connection between the metal tube 40 and the tank housing 32. The glass tube 42 extends above the metal tube 40 so that an electrical lead 46 cannot touch the metal tube 40. Both ends of the glass tube 42 are fused so that the tube and leads are sealed and impervious to moisture. Air is preferably not evacuated from the glass tube 42 for better heat conduction to the outer surface, but operation with some degree of a vacuum in the tube is possible. A bottom lead 48 extends through the glass tube 42 and out the end of the metal tube 40 so that it can be easily connected to the bottom outside of the metal tube 40. A durable electrical connection 47 is connected to the outside of the metal tube 40 and extended outside the tank 32.

A larger metal tube 50, preferably formed of brass, is mounted coaxially outside of the metal tube 40 so that the top of the metal tube 50 extends above the top of the glass tube 42, and the bottom of this metal tube 50 extends just above the bottom of the glass tube 42. This outer metal tube 50 acts as an insulator, protects the inner, relatively delicate, tubes 40,42 from damage, and protects against human contact with any components at the high heat of the coil 44. Also, the tube 50 becomes an electrical conductor so that the lead 46 from the top of the coil 44 so that a durable electrical lead 52 can be connected to the tube 50.

The liquid 34 is loaded through the tank filler hole 34*a*. A rubber stopper 54 seals the tank 32 so that no air or fluid can escape. The rubber bulb 36 is mounted on an air delivery tube 56 that extends to an air-tight connection 58 to the tank 32. Because the only vent to atmosphere from the heater is the tube 40, the liquid 34 does not flow out of the heater when the gun 10 is laid on its side, or even when it is held upside down, just as olive oil will not pour easily from a can that has only one small hole punched in its upper end. This characteristic of the smoke generator is referred to herein as "closed".

Although the close fit between the glass tube 42 and the metal tube 40 could be considered a capillary space, the opposite effect is desired. When the rubber bulb 36 is squeezed, air is delivered to the tank 32 which in turn exerts positive fluid pressure on the liquid 34. This liquid is pumped up into the metal tube 40 and over the glass tube 42 where it is vaporized rapidly by the high heat produced by the coil 44. When the rubber bulb 36 is released, negative pressure is delivered to the tank 32. This allows the coil 44 to rapidly heat to its highest temperature without loss of heat to the liquid. Also, the evacuation of the fluid from the region around the coil 44 in response to a decrease from the increased (pumping) fluid pressure conserves power through an increase in electrical resistance produced by the increased heat of the coil when the heat sink of the surrounding liquid is withdrawn. This conservation of power is important in that the heater 38 is powered by battery.

In addition, when fluid is delivered to the metal tube 40 by squeezing the rubber bulb 36, not all the fluid is vaporized, particularly if the squeezing is strong, or rapidly repeated before vaporization occurs. This excess fluid overflows the tube 40, runs down the outside of the tube 40 to the bottom of an annular catch well 90 between the tubes 50 and 40. This liquid, if allowed to build up, would rob heat from the metal tube 40. A drainage hole 60 at the bottom of the well 90 allows the excess fluid to drain into a separate tank 62. Another drain line 63 empties condensate from the smoke chamber 14 to the tank 62. The liquid collected in the tank 62 can then be removed through an access hole 64 and rubber stopper 66.

FIG. 2 shows the heat generator 30 installed in a toy gun 10, in this case, a pistol styled like a fanciful "ray gun". The body 16 of this gun includes a hollow casing of plastic or other suitable material. The gun body 16 is preferably molded from a suitable plastic in two mirror-image halves with the hand grip 20 and battery compartment 28. The smoke chamber 14 can be formed integrally therewith, but preferably is molded separately and then secured to the front end of the gun body 16 (e.g., with a snap-on action) after the two halves are mated in clam-shell fashion. Rearward depression of the trigger 22 operates to engage an axially extending actuator (or "striker") 68 through a pivoted, spring-loaded dog 70, causing a like rearward movement of the actuator from a forward position adjacent the diaphragm 74 to an extreme rear position against the action of a coiled compression spring 80. The dog 70 is mounted in a recess 68r formed in the lower side of the actuator 68. At the rear limit position, a corner 72 of the body 16 cams the dog 70 to pivot against its spring 71 until it releases from the trigger 22. This release allows the actuator to slide forward propelled by the compressed spring 80 to strike an elastic diaphragm 74. It also defines the rear limit position of the movement of the actuator 68.

With reference to FIG. 2, the smoke chamber 14 is defined by the diaphragm 74 (forming a generally planar rear wall 14*b*), a front wall 14*a* in generally parallel, spaced relation with the rear wall, and a generally cylindrical side wall 14*c* extending between walls 14*a* and 14*b*. The diaphragm 74 is preferably replaceably sandwiched between the smoke chamber 14 and the gun body 16, and it can be mounted in a separate circular frame 76 that is so secured. A generally circular orifice 14*d* is formed in the front wall as an exit port for the smoke rings 12. The orifice 14*d* is preferably positioned coaxially with the diaphragm 74. In the preferred form shown for a hand-held toy gun 10, the diameter of the orifice is in the range of about 1 to 3 inches, with about 1.25 inches being generally preferred.

The upper outlet end of tube 50 of the smoke generator 30 passes through a lower portion of the chamber side wall 14*c* to feed smoke produced by the generator 30 to the smoke chamber. An optional light 78 is attached inside the chamber wall 14*c* to facilitate visual inspection of the smoke in the chamber 14 and, in particular embodiments, to add illumination to the smoke inside the smoke chamber and/or to the rings eminating from it, particularly in darkened rooms. The chamber 40 can be made (whole or in part) from a transparent or translucent material such as a suitable plastic, such as polypropylene.

The ratio of the diameter of the orifice 14*d* to the internal diameter of the smoke chamber 14 is adjustable to maximize smoke ring quality and output by holding smoke in the chamber after it is produced, and then producing a well formed ring after the gun is "fired". Typically, that ratio is as low as about 1:4, but preferably in a range of about 1:2 to 2:3. By way of illustration, but not of limitation, the orifice 14*d*, as noted above, has a diameter of about 1.25 inches, and the internal diameter of the smoke chamber 40 is about 2.5 inches. The chamber diameter ranges from 2 to 5 inches for the preferred gun 10 shown in FIGS. 2 and 3.

The gun is "fired" to eject at least one smoke ring by the actuator 68 striking the diaphragm 74. The actuator in the preferred form illustrated is mounted in the body 16 at at least two axially separate bearing surfaces 16*a* and 16*b*. The actuator 68 reciprocates freely along its lengthwise axis in the direction of the axial arrow 18. As shown in FIGS. 2 and 3, the actuator is approaching its forward position where the actuator head 82 strikes the diaphragm 74. The resilience of the diaphragm material (and ribs 74*a*) returns the diaphragm to its original shape and returns the actuator 68 to a point where the trigger 22 when in its forward or unsprung position can engage the dog 70 and the gun can be fired again. There is no limiting forward position to the actuator other than the diaphragm. If the actuator stopped abruptly (or snaps) at a limit position, it is found that the ensuing pressure wave is not conducive to well-formed smoke rings.

In the preferred form, the actuator is also generally centered on the diaphragm 74 and the orifice 14d. The coil spring 80 held in a cavity 16*c* formed at the center rear of the gun body urges the actuator forward, toward the diaphragm. The spring, when compressed, provides a motive force that propels the actuator to strike the diaphragm with its head 82 to deflect the diaphragm forwardly to thereby produce a pressure wave in the fluid in the smoke chamber 14. In the preferred form shown, the spring 80 is captured at its front end on an end boss 68*a* of the actuator, and at its rear end the spring 80 abuts an adjustable stop member 84. The stop 84 pivots freely about a pivot pin 84*a* in response to a manual movement of projecting lever 84*b*. The pivot is not centered in the main body 84*c* of the stop 84 so that rotation (in the clockwise direction as shown) produces a camming action that compresses the spring 80. The force of the spring 80 on the stop, and friction with the pin 84*a* and the surrounding body 16, secures it against further rotation once it is manually set. This manual rotation of the stop allows a convenient adjustment of the actuator striking force, and thereby the speed of the smoke rings ejected by the gun 10 when it is fired.

The actuator head 82 is preferably circular with a diameter near in size to that of the orifice 14*d*. The striking face 82*a* is preferably flat. The impact of the face 82*a* on the diaphragm 74 deflects the diaphragm forward a short distance, one sufficient to create a pressure wave within the smoke chamber that in turn creates a smoke ring that ejects from the gun 10 and travels forward, in an axial direction with respect to the gun. The quality, speed and number of smoke rings created depends on an interplay of factors such as the material, thickness, tension and mounting of the diaphragm, the rigidity of the striking face 82*a*, the mass and velocity of the actuator, and the absolute and relative sizes of the areas of the diaphragm and the striking face that interreact. In one form, as illustrated and as noted above, the diaphragm is an edge-mounted piece of latex rubber about 10 mils thick held so that it is flat before it is struck, but not stretched to any significant degree. If the diaphragm is tensioned, the actuator impact can produce a bouncing leading to the formation of multiple surges per firing (which may be desirable under certain circumstances). However, to produce a quality traveling ring with one impact, and use a taut diaphragm, the actuator head 82*a* preferably mounts a layer of foam rubber or like energy absorbing or "lossy" material to cushion the blow.

While the preferred embodiment uses an elastic diaphragm, it will be recognized that there are many ways to move a member to produce a wavefront in an adjacent fluid. For example, a rigid or resilient member can be mounted to move in the manner of a piston within a cylinder (e.g., the smoke chamber side wall), or the diaphragm can be coupled to a solenoid in the manner of a diaphragm in a telephone or loudspeaker, or a diaphragm can itself be formed of materials, or layers of materials, that deform in response, e.g., to applied voltages in manner that produces the desired pressure wave. These variations are intended to fall within the scope of the appended claims.

It is also contemplated, and it is presently preferred, to use an elastic diaphragm 74' that is bowed or curved slightly in cross sction, e.g., ⅛ to ¼ inch measured at the center at a maximum. The direction of this curvature is convex with respect to the actuator head 82 (shown in dashed lines in FIG. 2.). To restore this curved shape after being impacted by the actuator and driven toward a flat or concave configuration, a set of radial ribs 74a mutually-spaced may be formed integrally in the diaphragm material.

Similarly, while the actuator is described as a spring-loaded, linearly reciprocating "plunger", an equivalent striking member can be formed in a wide variety of ways well known to those skilled in the art. Some examples are pivoting strikers (using a hammer-like pivoting action), solenoid-driven, pneumatically, and hydraulically-driven strikers, as well as direct drives for a rigid, piston-like diaphragm or diaphragm mountings.

In the preferred, hand-gun form illustrated herein, the tube 40 is preferably made from a metal or alloy thereof such as stainless steel. The envelope 42 of the heater, made from a high temperature silicate such as borosilicate glass, extends vertically so that its bottom end is above the top of the liquid 24 in the tank 32, and its upper end extends above the upper end of the metal tube 40. The metal tube 40 for a hand-gun 10 has an outer diameter of preferably 0.05 to about 0.07 inch, more preferably about 0.0546 to about 0.066 inch. Typically, the glass tube 42 preferably has an outer diameter of between about 0.049 to 0.055 inch, more preferably about 0.049 inch. A preferred radial spacing of the glass tube 42 to the inner wall of the tube 40 is between from about 0.001 to about 0.005 inch, preferably about 0.004 inch. This spacing has been found to promote the pumped movement of a suitable volume of liquid 34 to a region adjacent the heater in response to a pressure increase that can be produced manually, but not so much liquid that it strongly gushes up and out of the tube 40, or requires a significant time delay for vaporization. In the preferred form, the heater reaches its operating temperature in about 5 seconds, and smoke can then be made repeatedly, on demand, in about ½ second.

The invention is compatible with a wide range of suitable smoke precursor liquids. However as discussed, it is an object of this invention to provide smoke that is essentially safe for use in settings in which humans are present. Preferably, that smoke is made from liquid that is approved by the U.S. Food and Drug Administration (FDA). A preferred liquid is water having a smoke producing amount of propylene glycol and less than about 5 ppm mineral impurities. Such liquid can be obtained from a variety of commercial sources including "Fog fluid FJ1Q, unscented" from Visual Effects Inc. of Bronx, N.Y. (USA).

The resistance coil 44 has a resistance of from between about 4 ohms to about 10 ohms when cold (room temperature), and draws about 400 to about 600 milliamps in normal use to produce smoke. In the absence of liquid, the coil heat continues to draw current, but its resistance increases without the liquid acting as a heat sink. In this "liquid-withdrawn" state, it draws preferably about 300 to 450 milliamps, a conservation of about ⅓ of the current drawn when vaporizing (assuming a fixed voltage). The resistance coil can be made from a wide range of suitable materials, but nickel or alloys of nickel are preferred. Nickel that is at least about 99.9% pure is preferred for use in the hand-gun 10 shown in FIG. 2. The preferred coil has an outer diameter (O.D.) of about 0.02 inch.

A user of the toy gun 10 closes an electrical switch 86 to power the resistance coil 44 and energize the light 78. Power can be supplied by any suitable means including the batteries 24, or a cord extension to a household electrical socket or transformer. In the preferred toy gun embodiment using batteries for maximum portability, a battery compartment in the base 28 houses 6 AA batteries in series to provide about 9.0 volts with fresh batteries. After use, the voltage drops to about 7.5 volts, and after about 3 hours of use, to about 6.0 volts.

A second "trigger" 88 mounted in the hand grip 20, when depressed against a spring force by the user, contacts and compresses the bulb 36 to increase fluid pressure in the tank 32. This spring force acting on the trigger 88 is preferably provided by the resiliency of the bulb 36 itself. This increase in fluid pressure causes a rise in level of the liquid 34 into the annular space 43 between the heater and the tube 40, toward the resistance coil 44. The small volume of liquid in this narrow annular space 43 vaporizes very quickly (about ½ second) to produce smoke. That smoke rises into and fills the smoke chamber 14. If the trigger 88 is pulled too strongly, or too often, the pumped liquid can overflow the tube 40. If so, it runs into the well 90 at the bottom of the annular space between the tubes 40 and 50 where it is drained away so that it does not interfere with the vaporization process. Release of the trigger 88 lowers the fluid pressure as the resilient bulb 36 expands back toward its pre-compressed configuration. This decrease from the increased fluid pressure level immediately causes the liquid 34 to withdraw from the space 43 adjacent the heater 38. Smoke generation then, in most cases, ceases promptly.

The toy gun thus has a readily available supply of liquid 34 in tank 32, for repeated fast production of batches of smoke "on demand". Of course, the smoke generator 30 can be operated continuously or semi-continously, not "on-demand". However, continous or semicontinuous operation requires a greater power and liquid usage, and a likely waste of smoke that is produced, fills the chamber 14, and flows, unstructured, out of the orifice 14*d*, not as rings. As discussed above, the toy gun 10 can operate generally independently of orientation so that smoke rings can be produced with, e.g., a sideway or even upside down orientation, or the gun can be placed on its side when not in use. As also discussed above, the smoke generator 30 and gun 10 of the present invention can operate with water-based smoke precursor liquids (usually water with polyglycol, or the like, and a low level of mineral impurities). Smoke formed from such liquids are less likely to be irritating, or to have other health hazards, than known oil-based liquids.

Although the invention has been shown and described with respect to its preferred embodiments, it will be appreciated from the foregoing that various other changes, omissions and additions will occur to those skilled in the art without departing from the spirit and scope of the invention.

For example, while the invention has been described with respect to an air-filled, deformable bulb as a source of a variable pressure acting as the liquid 34 in the tank 32, a wide variety of other arrangements can achieve the same end effect. The liquid can be held in a deformable tank. A piston and cylinder arrangement can vary the pressure hydraulically. A compressed air supply or gas from a $CO_2$ cartridge can be applied to the tank. Further, while the heater has been described as an electrical resistance wire in a glass envelope, a wide variety of resistance and other heaters are known that can be adapted to vaporize the liquid, whether continuously or on demand. Further, while a hand gun is described as the preferred application of the present invention, it will be recognized that the invention can be readily adapted to other toys (toy rifles, bazookas, and cannons, and model trains and boats) and to other smoke applications (theatrical productions).

These and other modifications and variations disclosed herein are intended to fall within the scope of the appended claims.

What is claimed is:

1. A smoke generator comprising:

a) a supply tank that holds the liquid, b) a source of variable fluid pressure in sealed fluid communication with the supply tank for increasing and decreasing fluid pressure in the tank to feed the liquid to and from a heating unit;

c) a first tube with a first end entering into the supply tank, and a second smoke outlet end; and d) a heater positioned at least partially within the first tube for vaporizing the pressurized liquid driven by an increase in the pressure into a narrow annular region between the heating element and the surrounding tube.

2. A smoke generator comprising:

a) a tank holding a supply of a liquid that can be vaporized to produce the smoke, b) a first tube that has a first end in fluid communication with the fluid in said tank and extending generally upwardly from said tank, c) a heater disposed in said first tube above said liquid in said tank, and spaced from said heater and said first tube, and d) a variable fluid pressure source generally connected to the tank operable to force the said liquid from said tank into said heater-to-tube space in response to an increase in the pressure produced by said variable fluid pressure source from a first level, and evacuate the fluid from said heater-to-tube space in response to a decrease in said pressure from said increased level, said heater vaporizing the portion of said liquid driven by said pressure increase into said heater-to-tube space to produce the smoke.

3. The smoke generator of claim 2, wherein the variable pressure source is a flexible bulb in sealed fluid connection to the supply tank.

4. The smoke generator of claim 2, wherein the heater comprises an electrical resistance heater sealed in a heat-conductive envelope.

5. The smoke generator of claim 4, wherein said heat-conductive envelope is glass.

6. The smoke generator of claim 2, wherein said heater is generally centered in said first tube and said heater-to-tube space is annular.

7. The smoke generator of claim 6, wherein the radial dimension of said annular space is in the range of about 0.001 to about 0.005 inch.

8. The smoke generator of claim 4, wherein said first tube is formed of a metal, and it forms part of an electrical connection to the electrical resistance heater.

9. The smoke generator of claim 8, wherein the metal is stainless steel.

10. The smoke generator of claim 2 further comprising a second tube that is disposed generally concentrically around said first tube and defining a liquid catch well therebetween.

11. The smoke generator of claim 10, wherein said second tube is formed of a metal, and it forms part of an electrical connection to the electrical resistance coil.

12. A toy smoke-ring gun comprising:

a body extending generally in an axial direction, a smoke chamber at a front end of said body, said smoke chamber having front, rear and side walls and an outlet orifice formed in a front end wall for forming smoke rings that travel axially, an axially displaceable member forming at least part of said rear end wall that is generally parallel to, and spaced from, said front end wall, a smoke generator whose outlet is in fluid communication with said smoke chamber, said smoke generator including a heater, a supply of a smoke-producing liquid in a tank, and a pressurizer acting on said liquid supply to produce on-demand smoke to said smoke chamber, and a first tube extends into said liquid supply at a lowered end and surrounds said heater over a region above said tank; and an actuator mounted on the body and operable to move the displaceable member to produce a wave pressure inside the smoke chamber that causes a traveling smoke ring to be formed as a portion of the smoke held in the smoke chamber is ejected through said orifice.

13. The toy gun of claim 12, wherein said pressurizer comprises an air-filled bulb in sealed fluid communication with said smoke-generating liqud in said tank.

14. The toy gun of claim 13, wherein the heater is in the first tube to vaporize the smoke, producing fluid when said pressurizer is activated to produce an increased pressure level in such tank that drives said liquid upwardly into said first tube.

15. The toy gun of claim 14, wherein the heating element further comprises an electrical resistance heating coil, and further comprising a battery powering said heater coil and a switch connected therebetween to control the activation of said coil.

16. The toy gun of claim 15, wherein said coil draws a current of between from about 400 to 600 milliamperes with said liquid adjacent said heater within said first tube, and draws less current, due to an increased resistance when said liquid is withdrawn from said first tube, in response to a decrease in the fluid pressure provided by said pressurizer.

17. The toy gun of claim 16, further comprising a sealed vessel that encloses said resistance coil and wires extending through said vessel to connect electrically said coil to said battery and support it in a spaced relationship with respect to said vessel.

18. The toy gun of claim 17, wherein the vessel consists of a glass.

19. The toy gun of claim 18 wherein the radial spacing between the glass vessel and said first tube is between from about 0.001 to about 0.005 inches.

20. The toy gun of claim 19, wherein the first tube is formed of a metal.

21. The toy gun of claim 12, wherein the smoke generator further comprises a second metal tube coaxial with and surrounding said first tube and defining a catch well for said liquid therebetween.

22. The toy gun of claim 12 wherein said axially displaceable member comprises a diaphragm of an elastic material.

23. The toy gun of claim 22 wherein said diaphragm is generally circular and edge-mounted to form at least a portion of said rear wall.

24. The toy gun of claim 23 wherein said diaphragm is formed of rubber.

25. The toy gun of claim 23 wherein said diaphragm is generally coaxial with said orifice and said actuator is movable to strike said diaphragm to produce said pressure wave.

26. The toy gun of claim 25 wherein said diaphragm has a low tension and said actuator is rigid.

27. The toy gun of claim 22 wherein said actuator is a member that is linearly slidable within said body and further comprising a spring captured between a rear end of said member and said body.

* * * * *

UNITED STATES PATENT AND TRADEMARK OFFICE

CERTIFICATE OF CORRECTION

PATENT NO. : 6,421,502 B1 
DATED : July 16, 2002
INVENTOR(S) : Alan Aronie et al.

It is certified that error appears in the above-identified patent and that said Letters Patent is hereby corrected as shown below:

Title page,
Item [73], correct the address of the Assignee, "Quikpoint, Inc.," from "Concord, CA (US)" to -- Concord, MA (US) --.

Signed and Sealed this

Twenty-sixth Day of November, 2002

*Attest:*

*Attesting Officer*

JAMES E. ROGAN
*Director of the United States Patent and Trademark Office*